United States Patent [19]

Smale

[11] Patent Number: 4,672,907

[45] Date of Patent: Jun. 16, 1987

[54] SAILS

[75] Inventor: Geoffrey A. Smale, Campbells Bay, New Zealand

[73] Assignee: Larnaston Limited, London, England

[21] Appl. No.: 838,439

[22] Filed: Mar. 10, 1986

Related U.S. Application Data

[63] Continuation of Ser. No. 608,423, May 9, 1984, abandoned.

[30] Foreign Application Priority Data

May 16, 1983 [NZ] New Zealand ..... 204231
Aug. 17, 1983 [NZ] New Zealand ..... 205303
Aug. 17, 1983 [NZ] New Zealand ..... 205302

[51] Int. Cl.[4] ..... B63H 9/06
[52] U.S. Cl. ..... 114/103; 114/102
[58] Field of Search ..... 114/39, 102, 103, 105, 114/109

[56] References Cited

U.S. PATENT DOCUMENTS

| | | | |
|---|---|---|---|
| 517,193 | 3/1894 | Ratsey | 114/102 |
| 2,275,159 | 3/1942 | Nye, Jr. | 114/102 |
| 2,499,598 | 3/1950 | Maurer | 114/103 |
| 2,620,760 | 12/1952 | Mielges | 114/103 |
| 3,626,886 | 12/1971 | Cafiero | 114/102 |
| 3,680,519 | 8/1972 | Jalbert | 114/102 |
| 3,903,826 | 9/1975 | Anderson | 114/102 |

FOREIGN PATENT DOCUMENTS

| | | | |
|---|---|---|---|
| 2501326 | 7/1976 | Fed. Rep. of Germany | 114/102 |

OTHER PUBLICATIONS

A Glossary of Sea Terms by Gershom Bradford Pub--Dood, Mead, & Ko. 1942.

Colgate, Steve, "Rudiments of Luff Tension", *The Best of Sail Trim*, Granada Publishing Ltd. (1981), pp. 125-127.

*Primary Examiner*—Joseph F. Peters, Jr.
*Assistant Examiner*—C. T. Bartz
*Attorney, Agent, or Firm*—Young & Thompson

[57] ABSTRACT

The luff area of a sail is stabilized by arranging the directional stability of the sail material to help support the load on the luff area of the sail between the head and the tack. Different sail constructions utilize triangular or trapezoidal panels along the luff area of the sail so that the line of maximum directional stability of the material in each panel is arranged to counteract the lines of stress appearing in the sail between the vicinity of the head and the vicinity of the tack when under load and properly tensioned. A similar technique can be used to stabilize the foot area of the sail.

11 Claims, 9 Drawing Figures

SAILS

This application is a continuation of application Ser. No. 608,423, filed 5/9/84, now abandoned.

BACKGROUND OF THE INVENTION

Sail making is the art of compromise. The sail maker is concerned with the stretch characteristics of the sail material. Sails are typically constructed by shaping and joining together panels of material, so as to present a relatively controllable aerofoil when tensioned and subject to different wind strengths.

Until the discovery of synthetic fabrics, sails were traditionally produced from various types of canvas. Today, virtually all fore and aft sails (other than spinnakers) are made from polyester fabrics, in particular polyethylene tetraphthalate (trade names: Dacron, Terylene). With sails made from this polyester woven fabric, it is generally convenient to provide maximum directional strength along the weft of the fabric. Even though both the warp and weft stability of the fabric may be controlled, the fabric will exhibit bias stretch, i.e. along the diagonal of the matrix defined by the generally orthogonal warp and weft yarns.

Designers have concentrated on the stability of the leech in both headsails and mainsails, as the leech is generally unsupported, unlike the luff of a headsail which is tensioned by a fore stay, or the luff of the mainsail which is held by the mast.

Until the turn of the century triangular sails were scotch-cut, i.e. with the sail panels lying parallel with the leech. This meant that the warp was was parallel to the leech, and the panels met the luff and the foot on the bias. Ratsey made a significant improvement to said design when he discovered that weft stretch was more predictable than that of the warp and in his design he laid the panels at 90 degrees to the leech, thus lining up the stable weft yarns between the head and clew of the sail to stabilize the leech. Indeed, Ratsey, in his 1894 patent disclosed the concept of the mitre cut in which the panels are arranged so that the weft threads are parallel to the leech, and a separate set of panels are arranged with their weft threads parallel with the foot, the two sets of panels meeting along a mitre line.

The mitre cut and the more recent cross cut (in which all the panels have the weft parallel to the leech) result in bias stretch in the luff area of the sail, i.e. the area between the head and tack bounded by the luff (edge) and the draft (the point of maximum camber when under sail).

PRIOR ART

Ratsey, U.S. Pat. No. 517,193, of 1894 teaches the provision of sail panels in which the weft is parallel to the leech.

Nye, U.S. Pat. No. 2,275,159, of 1942 illustrates the cross-cut configuration together with a reinforced hem.

Cafiero, U.S. Pat. No. 3,626,886, of 1971 teaches the provision of warp and weft at 60 degrees so that the weft is parallel to the leech, and the warp is parallel to the foot (with the result that the luff is again cut along the bias of the panels).

Jalbert, U.S. Pat. No. 3,680,519, of 1972 teaches sail construction from a plurality of triangular panels diverging from the tack.

Andersen, U.S. Pat. No. 3,903,826 of 1975 suggests the use of a relatively stiff sail made from overlapping layers of fibreglass. Three layers of stretch resistant material are suggested so that the threads of each are respectively parallel to the leech, the luff, and the foot of the sail.

The Best of Sail Trim, 1981, published by Granada Publishing Ltd (ISBN 0 229 11566 7) at page 125, contains an article entitled "Rudiments of Luff Tension" by Steve Colgate. This discusses the problem of bias stretch along the luff edge with the result that as wind speed increases, the sail material stretches and the draft tends to move aft towards the leech. This is undesirable as it produces a less efficient aerofoil.

SUMMARY OF THE INVENTION

It is an object of this invention to provide improved sails, and an improved method of constructing sails, in which stretch or distortion in the luff area is minimised.

In one aspect, the invention provides a sail having a luff portion formed from material having lines of directional stability extending between the vicinity of the head and the vicinity of the tack of the sail.

In a second aspect, the invention provides a sail having an improved luff area formed from material whose directional stability is chosen so as to substantially coincide with lines of stress appearing in the sail between the vicinity of the head and the vicinity of the tack when under load and properly tensioned.

In another aspect, the invention provides a method of constructing sails in which the sail is formed from separate panels, at least some of which have their lines of directional stability arranged to give maximum support to the luff area between the head and tack of the sail. This method allows the sail maker to use cross-cut, or other panels along the leech, and thereby control the position of the bias interface between the luff area and the leech area.

BRIEF DESCRIPTION OF THE DRAWINGS

The above gives a broad description of the present invention, a preferred form of which will now be described by way of example with reference to the accompanying drawings in which.

DETAILED DESCRIPTION OF THE PREFERRED EMBODIMENT

Figure 1:
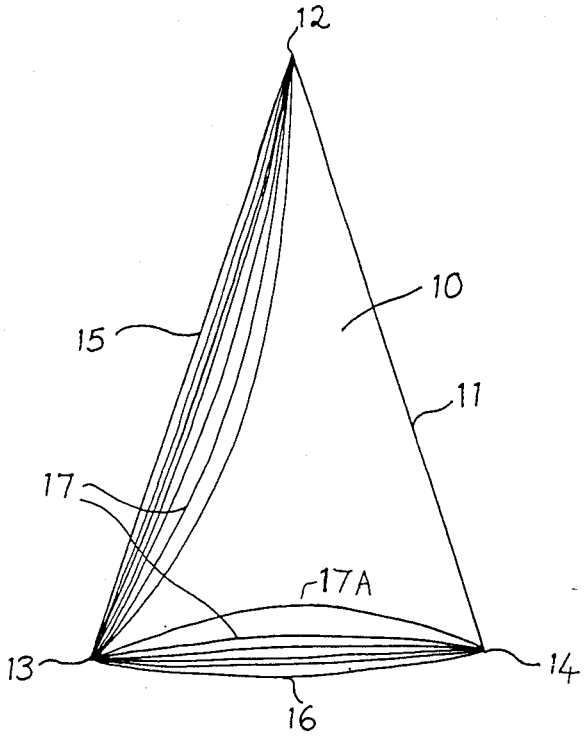
FIG. 1 illustrates the lines of stress in a headsail when properly tensioned.

A headsail 10, e.g. a jib, has a leech 11, a head 12, a tack 13, a clew 14, a luff 15 and a foot 16, as shown in FIG. 1.

In accordance with usual practice, the luff edge can be tensioned by a luff wire or rope within a hem along the luff edge of the sail.

When under load and properly tensioned, the sail will assume the characteristic of an aerofoil (see FIG. 2) and will exhibit lines of stress 17 (see FIG. 1) between the vicinity of the head 12 and the vicinity of the tack 13 exhibiting stress in the luff area; and between the vicinity of the tack 13 and the vicinity of the clew 14 exhibiting stress in the foot area of the sail. Similar lines of stress appear in mainsails, although the luff edge of the main sail is held more securely by the mast.

Figure 2:
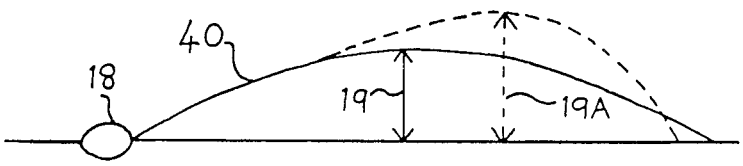
FIG. 2 illustrates the aerofoil shape of a mainsail.

FIG. 2 shows a conventional mainsail 40 connected to a mast 18. The draft 19 is the position of maximum camber. An increase in wind speed will cause the draft 19 to move back into the sail to position 19A, thus reducing the efficiency of the aerofoil. It is believed that this luff sag is the result of bias stretching in the luff area of the sail which occurs despite excessive tensioning of the luff edge. Attempts have been made to control this luff sag by cutting the luff edge as a concave curve to increase the luff tension in the case of headsails.

Figure 3:
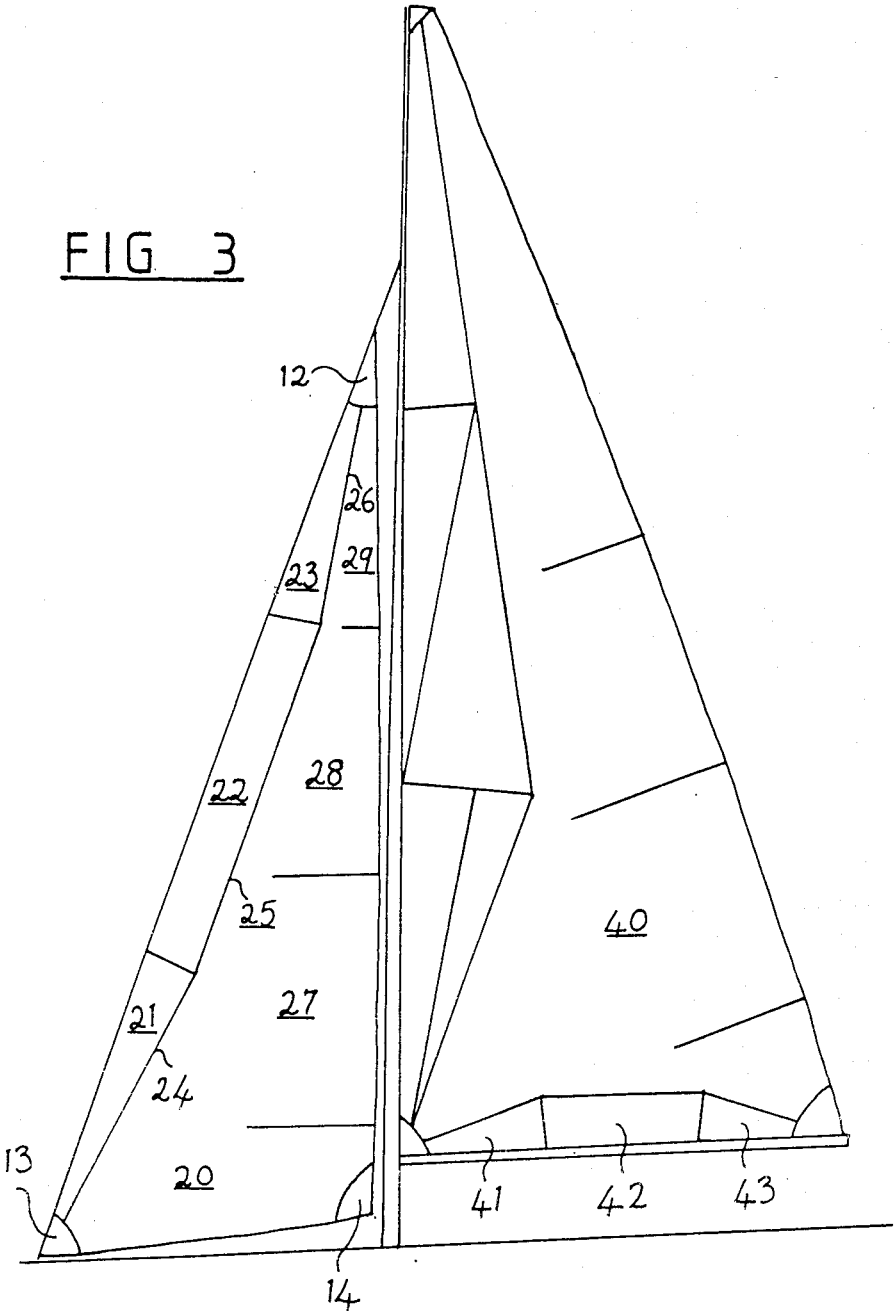
FIG. 3 illustrates a headsail and mainsail of this invention.

Turning now to FIG. 3, it will be seen that the headsail and mainsail are constructed with panels along their luff areas such that the directional stability of these panels is arranged in such a way as to be substantially parallel to the lines of stress along the luff area shown in FIG. 1. The polygonal panels 21 and 23 are of a substantially triangular shape and the central plane 22 is of a trapezoidal tetragonal shape. The long sides of panel 21 converge toward the tack and the long sides of panel 23 converge toward the head. In the case of woven material, either the warp or weft can be chosen as the source of principal directional stability. Whether the warp or weft direction is chosen as the direction of principal stability will depend upon the yarn and weaving characteristics, as well as the sail maker's cutting plan for the sails and sail panels. At present, utilising a composite Kevlar/Mylar, or Dacron/Mylar sail cloth, it is preferred that the luff panels are cut so that the warp threads are arranged substantially parallel to the lines of stress 7 between the head and tack, as shown in FIG. 1. This enables relatively long luff panels to be cut from the sail material.

Optionally, corresponding foot panels 41,42,43, can be provided, e.g. as shown in the mainsail 40 of FIG. 3, with the warp threads of these foot panels aligned substantially parallel to the lines of stress which would appear between the clew and tack of the mainsail or headsail.

The leech area of the headsail and mainsail may be formed in any convenient manner. Although this invention is concerned with an improvement to the luff area of sails, these luff panels are suited to the construction of sails having cross-cut leech panels as shown in FIGS. 3–8. It will be noted from FIG. 3 that the leech is made up of panels which are cross-cut so that the weft threads are aligned substantially parallel with the leech in each case.

Moreover, it will be noted that the interface or seam line between the leech and luff panels can be an interface between the warp alignment of the luff panels and the bias edge of the leech panels. For example, the interface between luff panel 21 and leech panel 27 of the headsail of FIG. 3 is at a more acute angle than is the interface between luff panel 23 and leech panel 29. The luff panels are cut from the sail material so that their inner edges 24, 25, 26 are substantially aligned with the warp threads of the fabric and thus these inner edges define the interface between the luff and leech panels. Edge 24 thus provides controlled or minimal stretch characteristics exhibited by the warp yarn of the luff panels tending to reduce or compensate for stretching along this bias edge of the leech panel 27. This however is an optional feature as the seam may not correspond to the lines of stress and warp direction of the luff panels as would be case with a curved seam.

Figure 4:
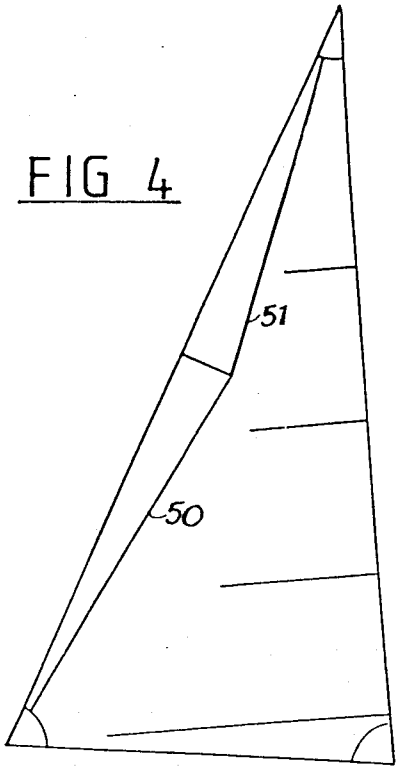

FIGS. 4–8 illustrate various configurations of headsails and mainsails. It will generally be convenient to form the luff area from a plurality of panels, and FIG. 4 illustrates a relatively simple design of a fore sail in which the luff area is formed from two triangular panels each of which is cut so that the warp threads lie parallel to the interface lines 50 and 51.

Figure 5:
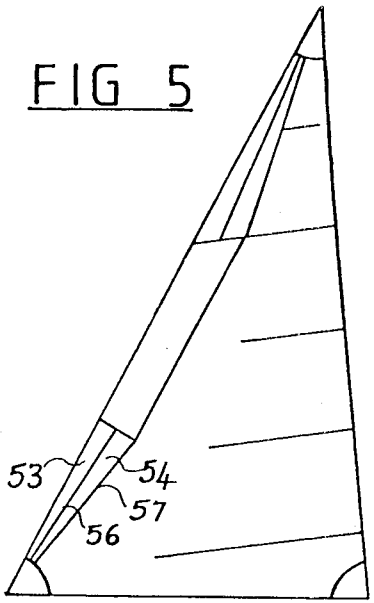
FIGS. 4–7 illustrate different configuration of headsails in accordance with this invention.

In the headsail of FIG. 5, the luff region is generally trapezoidal, and is formed from a plurality of panels. The lower luff panels 53 and 54 are arranged so that the weft of panel 53 is substantially parallel to interface 56 whilst the weft of panel 54 is substantially parallel to the interface 57. Thus as a general rule, it is preferred that the luff panels are cut so that the weft is substantially parallel to the inner-most edge or interface. This is a simplified guide to constructing panels to create directional stability along the lines of stress.

Figure 8:
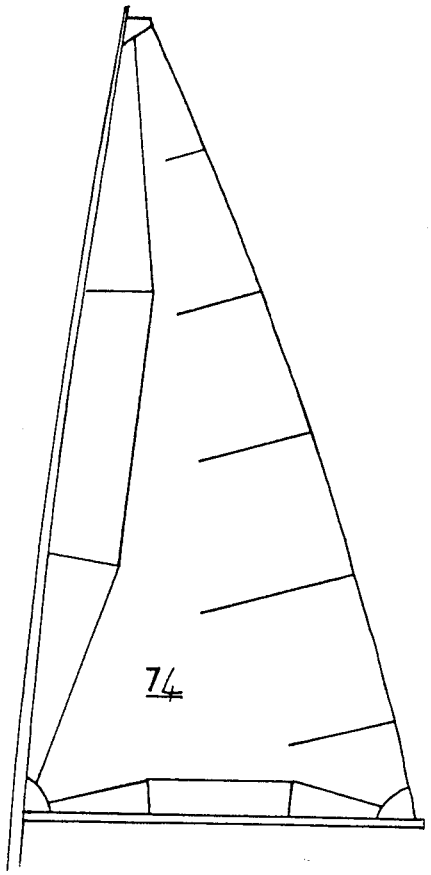
FIG. 8 illustrates an alternative mainsail construction in accordance with this invention.

Similar rules apply to the mainsails of FIGS. 3 and 8.

In addition to the luff areas, it is preferred that additional stability is provided along the foot of the sails by means of corresponding foot panels.

Figure 6:
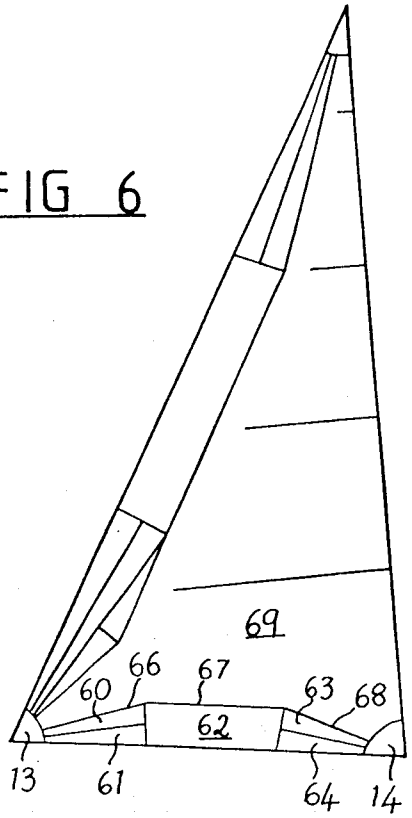

As is best seen from FIG. 6, foot panels 61, 62, 63, 64 extend between the reinforced tack 13 and reinforced clew 14 of a headsail. Once again, these panels are arranged so that their lines of directional stability correspond to the lines of stress between the tack and clew. Thus the innermost edges or interfaces of the panels, e.g. edges 66, 67, 68, etc. are cut so that they are substantially parallel to the warp direction of the material making up each foot panel, e.g. 60,62,63. Thus a line joining the warp yarns along the edges 66,67,68, will approximate the uppermost line of stress 17A in the foot area of FIG. 1.

Figure 7:
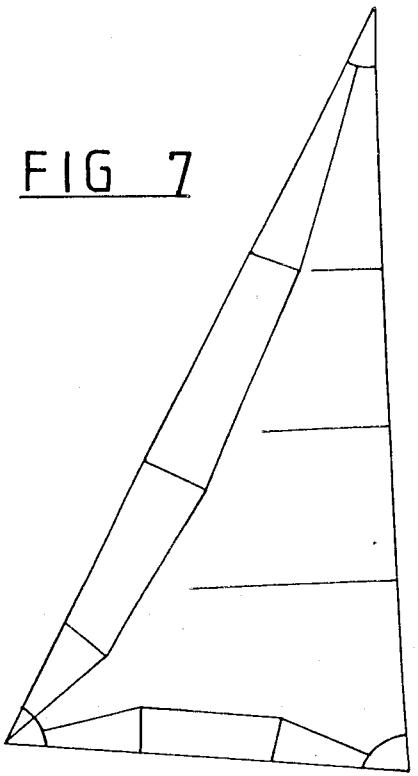

FIGS. 6 and 7 show more complex luff panels whose directional alignment of yarns tend to approximate more closely the curved stress lines of FIG. 1. As more and shorter luff panels are used, these could be cut so that the weft yarns are aligned with the lines of stress of FIG. 1.

FIG. 8 shows a mainsail 74 combining a simple three panel trapezoidal luff area with a corresponding three panel trapezoidal foot area.

It has been found that the construction of sails utilised in this invention, reduces the need to shape the adjoining edges of the luff panels in order to set the sail into the required curve. Instead, sails can be cut from substantially flat panels and joined together along straight edges, with the required curvature being imparted by leech tapers and the foot shape. Thus sail cutting and sail construction can be simplified. It will be noted that the invention can be applied to sails formed from panels, which are stitched together as well as from panels which are secured together by adhesives, heat sealing, or any other suitable methods.

Figure 9:
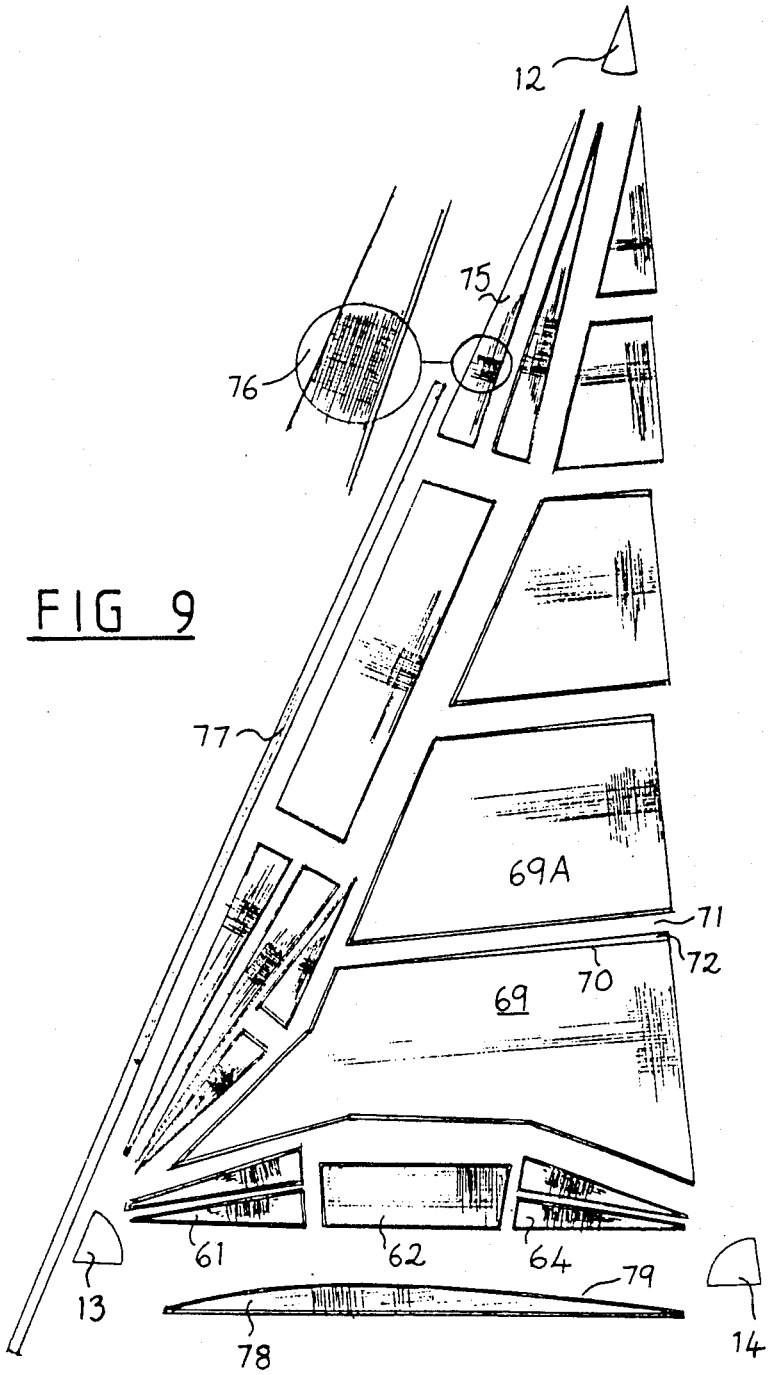
FIG. 9 illustrates a cuttting pattern and the yarn directions in the panels used to make up the sail of FIG. 6.

FIG. 9 shows how the sail of FIG. 6 is made. The individual panels are shown together with the direction of weave and laps between adjacent panels. The alignment of the material is best seen in the enlarged view 76 of a portion of the upper luff panel 75.

Luff tabling 77 and a shaped foot shelf panel 78 are shown, (although they have been omitted from FIG. 6 for the sake of clarity).

The lap between adjacent leech panels 69 and 69A is shown by the slightly curved line 70 of panel 69 which is joined to the lower edge 71 of panel 69A to create an overlapping portion 72.

The leech panels are cut in the crosscut fashion with weft yarns aligned parallel to the leech edge whereas the luff and foot panels have warp alignment as previously described.

The sail is assembled as a flat sheet with a straight luff prior to joining at tapered crosscut leech edges, e.g. 70,71. Then a shaped foot panel 78 is added with its curved edge 79 to the sail.

The aerofoil shape of the sail can be varied by suitably shaping the leech tapers 72 and the foot panel 78. Typically no luff hollow is necessary due to the stability of the luff area with this design.

Preferably the sail is additionally strengthened by the provision of reinforcing panels 12,13, and 14 at the corners of the sail. International Yacht Racing and Class rules usually control the amount and form of reinforcing permitted at the corners of the sails.

It will be apparent that utilising present day materials, sails are conveniently constructed from a plurality of panels cut from materials of known stretch characteristics, typically woven polyester fabrics, or possibly from non-woven materials, e.g. extruded or co-extruded plastics sheet. However, it will appreciated that sails could also be formed in one piece from material having specially chosen non-stretch characteristics, and in particular lines of directional stability substantially parallel to the lines of stress shown in FIG. 1. Such a material could be formed from a non-woven fabric, e.g. a glass-fibre reinforced resin product in which the fibres are aligned as shown by the lines of stress in FIG. 1.

Finally, it will be appreciated that various alterations or modifications may be made to the foregoing without departing from the scope of this invention as exemplified by the following claims.

I claim:

1. A sail having a luff edge and a plurality of luff panels in a luff area comprising: two polygonal panels closely approximating a triangular shape and each of which has two long sides and one short side, the projected apex between the two long sides of one said polygonal panel being disposed at the head of the sail and the projected apex between the two long sides of the other said polygonal panel being disposed at the foot of the sail, one of said long sides of each polygonal panel lying on the luff edge of the sail, each polygonal panel having warp or weft threads disposed substantially parallel to the other long side of each polygonal panel; and at least one central panel disposed between and having first and second sides secured to said short sides of said two polygonal panels, said at least one central panel having third and fourth opposite sides with the third side lying on the luff edge of the sail and the warp or weft threads of said at least one central panel being disposed substantially parallel to the fourth side of said at least one central panel; whereby said two polygonal panels and said at least one central panel together form an interior edge lying substantially on a line corresponding essentially to a line of principle stress exerted on said sail when subjected to wind load and properly tensioned.

2. A sail as claimed in claim 1, there being only one said central panel.

3. A sail as claimed in claim 1, there being a plurality of said central panels joined short end to short end in a series along the luff of the sail.

4. A sail having a plurality of luff panels with each panel having at least one set of lines of directional stability in the direction of which the panel has substantially greater resistance to deformation under tension than in another direction, said panels including two polygonal panels of substantially triangular configuration each of which has two long sides and one short side away from which said long sides converge, the two long sides of one polygonal panel converging toward and extending into the vicinity of the head of the sail and the two long sides of the other polygonal panel converging toward and extending into the vicinity of the tack of the sail, at least one of said long sides of said one polygonal panel extending away from the luff edge in the vicinity of the head and at least one of said long sides of said other polygonal panel extending away from the luff edge in the vicinity of the tack of the sail, said at least one set of lines of directional stability of each polygonal panel being disposed substantially parallel to said at least one of said long sides of each polygonal panel; and at least one tetragonal panel disposed between and joining said short sides of said polygonal panels, said at least one tetragonal panel having two opposite sides one of which is farther away from the luff edge than the other and is more nearly parallel to the luff edge than are either of said at least one of said long sides of said polygonal panels, said at least one set of lines of directional stability of said at least one tetragonal panel being disposed substantially parallel to said side located farther away from the luff edge; whereby said two polygonal panels and said at least one tetragonal panel together provide at least one line of reinforcement extending away from and then returning toward the luff edge between the vicinity of the head and the vicinity of the tack.

5. A sail as claimed in claim 4, there being only one said tetragonal panel which is elongated and is joined at opposite ends to the said short sides of each said polygonal panel.

6. A sail as claimed in claim 4, there being a plurality of said tetragonal panels joined to form an elongated series joined at opposite ends to the said short sides of each said polygonal panel.

7. A sail as claimed in claim 4, and further including additional polygonal panels of substantially triangular configuration adjoining said long sides of the first-mentioned polygonal panels.

8. A sail having a luff edge and a plurality of luff panels with each panel having at least one set of lines of directional stability in the direction of which the panel has substantially greater resistance to deformation under tension than in another direction, said panels including two polygonal panels of substantially triangular configuration each of which has two long sides and one short side away from which said long sides converge, the two long sides of one polygonal panel converging toward and extending into the vicinity of the head of the sail and the two long sides of the other polygonal panel converging toward and extending into the vicinity of the tack of the sail, at least one of said long sides of said one polygonal panel extending away from the luff edge in the vicinity of the head and at least one of said long sides of said other polygonal panel extending away from the luff edge in the vicinity of the tack of the sail, said at least one set of lines of directional stability of each polygonal panel being disposed substantially parallel to said at least one of said long sides of each polygonal panel; and at least a third polygonal panel disposed between and joining said short sides of said two polygonal panels, said at least a third polygonal panel having two opposite sides one of which is farther away from the luff edge than the other and is more nearly parallel to the luff edge than are either of said at least one of said long sides of said two polygonal panels, said at least one set of lines of directional stability of said at least a third polygonal panel being disposed substantially parallel to said side located farther away from the luff edge; whereby said two polygonal panels and said at least a third polygonal panel together provide at least one line of reinforcement extending away from and then returning toward the luff edge between the vicinity of the head and the vicinity of the tack.

9. A sail as claimed in claim 8, there being only one said third polygonal panel which is of an elongated rectangular configuration and is joined at opposite ends to the said short sides of said two polygonal panel.

10. A sail as claimed in claim 8, there being a plurality of said third polygonal panels joined to form an elongated series joined at opposite ends to the said short sides of said two polygonal panel.

11. A sail as claimed in claim 8, and further including additional polygonal panels of substantially triangular configuration adjoining said long sides of the firstmentioned two polygonal panels.

* * * * *